United States Patent [19]

Ishizuka et al.

[11] Patent Number: 4,974,533

[45] Date of Patent: Dec. 4, 1990

[54] COATING APPARATUS

[75] Inventors: Seiji Ishizuka; Toyomi Matuda, both of Kanagawa, Japan

[73] Assignee: Fuji Photo Film Co., Ltd., Kanagawa, Japan

[21] Appl. No.: 304,625

[22] Filed: Feb. 1, 1989

[30] Foreign Application Priority Data

Feb. 1, 1988 [JP] Japan ..... 63-21689

[51] Int. Cl.[5] ..... B05C 3/02

[52] U.S. Cl. ..... 118/411; 118/DIG. 4; 427/420

[58] Field of Search ..... 118/410, 411, 412, DIG. 4; 427/420

[56] References Cited

U.S. PATENT DOCUMENTS 4,019,906 4/1977 Ridley et al. ..... 427/420
4,230,743 10/1980 Nakamura et al. ..... 427/420
4,479,987 10/1984 Koepke et al. ..... 118/325
4,489,671 12/1984 Choinski ..... 118/412
4,830,887 5/1989 Reiter ..... 118/DIG. 4

*Primary Examiner*—Bernard Nozick
*Attorney, Agent, or Firm*—Sughrue, Mion, Zinn, Macpeak & Seas

[57] ABSTRACT

A coating apparatus for forming a curtain film of uniform thickness on a suitable substrate, particularly for production of recording/reproducing media such as photosensitive and magnetic media. Jets of an auxiliary liquid are provided in the vicinity of a lip portion of a liquid pouring device which pours the coating film on the substrate. The jets expel an auxiliary liquid which does not affect the characteristics of the coating film, but which does prevent thinning of the curtain film in the vicinity of edge guides of the apparatus. Depending on the height of the curtain film, more than one set of jets may be provided along the length of the curtain film.

5 Claims, 3 Drawing Sheets

COATING APPARATUS

This invention relates to a coating apparatus, and more specifically, to an apparatus for causing one or more film-like coating liquids to impinge on a web to be coated to thereby coat the web. The web may be a continuously-running strip-like substrate used in the manufacture of a photographic photosensitive material such as a photographic film and a photographic printing paper, a magnetic recording material such as a magnetic tape, an information recording paper such as a pressure sensitive paper and a thermosensitive paper, and other recording materials including a presensitized printing plate, etc.

BACKGROUND OF THE INVENTION

A typical example of coating apparatuses for coating a film-like coating liquid on a web is a curtain coating apparatus, in which a curtain of one or more coating liquids is created and is caused by gravity to impinge on an article to be coated so that a coating film is formed on the article. Such apparatus has been used from old times to coat furniture, a sheet of iron and so on. As demand for an improved coating quality has increased, so has the requirement for high precision coating. In recent years, the curtain coating apparatus has been applied to a field requiring a particular precision, such as in the manufacture of a photographic photosensitive material, as disclosed in U.S. Pat. Nos. 3,508,947 and 3,632,374.

U.S. Pat. No. 3,632,374 discloses a method of stably forming a curtain film to provide a small coating amount. In this method, perforated pipes 15 and 15' are incorporated respectively in edge guides 14 and 14' shown in FIG. 1, and an inert liquid such as a transparent gelatin solution is fed under pressure into the pipes from their upper ends so that the liquid exudes from axial slots formed in the edge guides.

However, with such an edge guide device, even if the auxiliary liquid is exuded in the direction of the width of the curtain film, any force is exerted on the coating liquid in its gravitating direction. This results in formation of a thinned film in the vicinity of each edge guide, thus prohibiting satisfactory stable formation of the curtain film.

Japanese Patent Publication No. 58-37866 describes a method in which in order to enhance the stabilization in providing a small coating amount opposite edges of a coating liquid curtain are supported by jets of a liquid in the direction of flow of the coating liquid. More specifically as shown in FIGS. 2 and 3, discharge ports 36 and 36' are provided at a lower portion of the curtain film 32 to discharge jets of an auxiliary liquid in the direction of flow of the coating liquid, to prevent the contracted flow of the curtain film at a region extending from lower ends of edge guides 24 and 24' to a surface of a web 22.

The just-described method has the advantage that the contracted flow of the curtain film in the vicinity of the lower ends of the edge guides is prevented thereby providing a uniform coated film having no locally-thickened portion. However, where the curtain is relatively tall, the coating liquid has sometimes been formed into a thinned film before it reaches the end of the discharge side, thus affecting uniformity.

It is considered that the formation of such a thinned film in the vicinity of the edge guides results from a so-called Marangoni effect, described in British patent application No. 2021001 A. It is surmised that since the surface concentration of the surface active component in the coating liquid depends on the rate of surface expansion, a distribution of the surface expansion rate caused by a velocity distribution near the edge guides gives rise to a difference of the surface active component in surface concentration that is, a difference in surface tension, so that the coating liquid is subjected to a force tending to attract it toward the portion of a higher surface tension in the curtain film.

SUMMARY OF THE INVENTION

In view of the foregoing, it is an object of the present invention to overcome the above deficiencies of the conventional coating methods and to provide a coating apparatus which eliminates the development of a thinned film in the vicinity of edge guides even if an increased curtain height is employed, thereby maintaining a stable formation of a curtain film in a small coating amount.

The foregoing and other objects are achieved by a coating apparatus wherein at least one film-like coating liquid is caused to impinge on a substrate to be coated so as to coat the same. The apparatus includes discharge means for discharging a liquid in a jet in a direction of downward flow of the coating liquid, the discharge means being mounted on edge guide portions either in the vicinity of a lip portion of a liquid pouring device or both in the vicinity of a lip portion of a liquid pouring device and in the vicinity of a point where the coating liquid is caused to impinge on the substrate to be coated, the edge guide portions supporting opposite edges of the film-like coating liquid. The latter arrangement is advantageous when the curtain is particularly tall.

BRIEF DESCRIPTION OF THE DRAWINGS

The present invention now will be described in detail with reference to the accompanying drawings, in which.

DETAILED DESCRIPTION OF THE PREFERRED EMBODIMENTS

Figure 1:
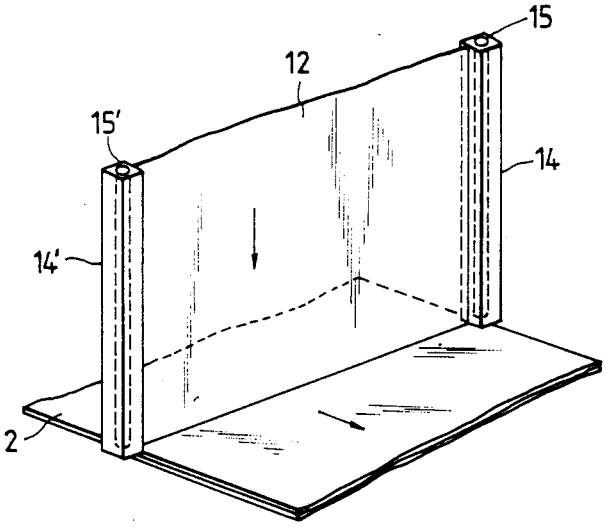
FIG. 1 PRIOR ART
FIG. 1 is a partial view of a conventional coating apparatus employing perforated pipes as edge guides.
Figure 2:
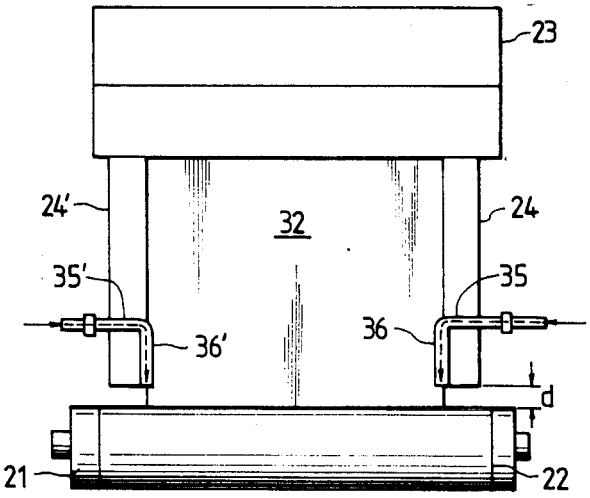
FIG. 2 PRIOR ART
FIG. 2 is a schematic front-elevational view of a conventional coating apparatus provided with auxiliary liquid discharge ports at a lower portion of a curtain film.
Figure 3:
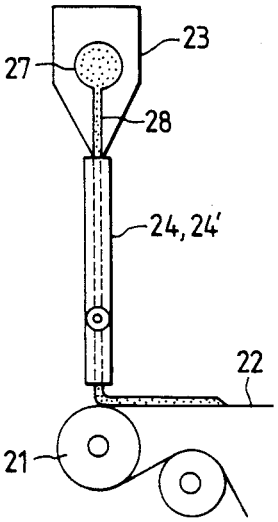
FIG. 3 PRIOR ART
FIG. 3 is a side-elevational view of the apparatus of FIG. 2.
Figure 4:
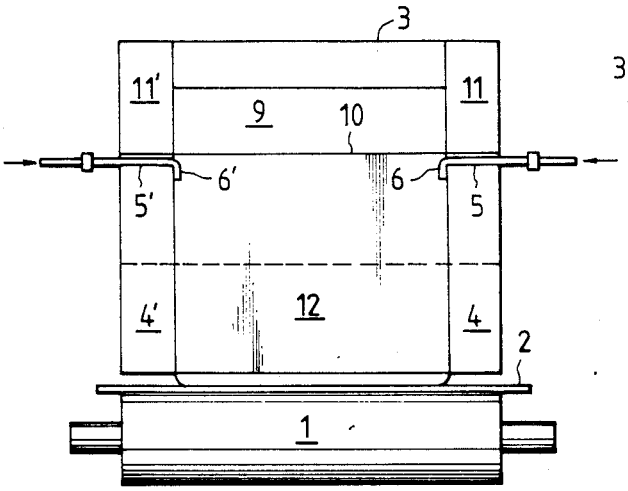
FIG. 4 is a schematic front-elevational view of a coating apparatus of the slide hopper type provided in accordance with the present invention.
Figure 5:
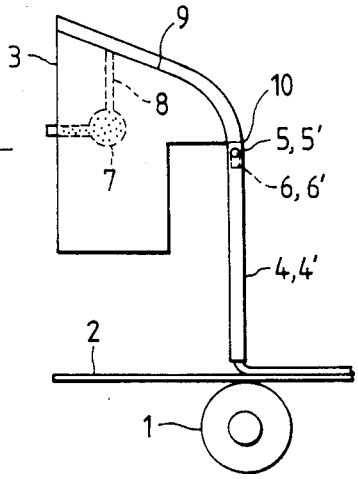
FIG. 5 is a side-elevational view of the apparatus of FIG. 4.

FIG. 4 is a schematic front-elevational view of a curtain coating apparatus employing a slide hopper type liquid pouring device, as one embodiment of the invention, and FIG. 5 is a side-elevational view thereof.

In FIGS. 4 and 5 a coating liquid is fed into a slide hopper type liquid pouring device 3 by a liquid feed pump (not shown), and is passed through a manifold 7 and slots 8. Then, the coating liquid flows downwardly as a film along a slide surface 9 while being limited at opposite side edges by guide plates 11 and 11', and reaches a lip portion 10 of the liquid pouring device 3. Then, the coating liquid flows from the lip portion 10 to create a curtain film 12 while being supported by edge guides 4 and 4', and is coated onto a web 2 supported by a backup roller 1.

An auxiliary liquid is fed by a liquid feed pump (not shown) into liquid pouring pipes 5 and 5' mounted respectively on the edge guides 4 and 4' in the vicinity of the lip portion 10 of the liquid pouring device 3. Then, the auxiliary liquid is caused to flow in a jet from each of discharge ports 6 and 6' along the curtain film 12 defined by the downwardly-flowing film of the coating liquid and is caused to impinge on the web 2 supported by the backup roller 1, together with the curtain film 12, to effect coating.

Figure 6:
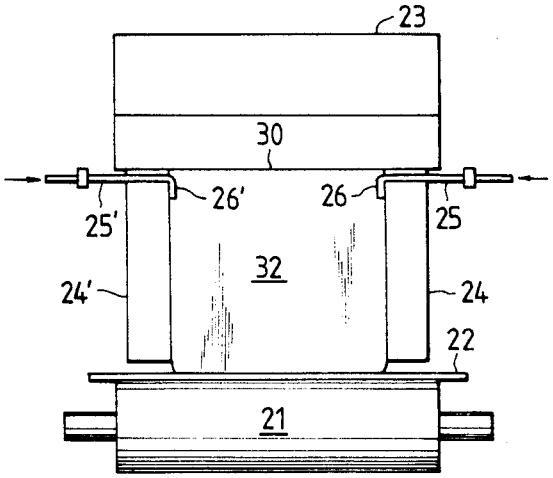
FIG. 6 is a schematic front-elevational view of a coating apparatus of the extrusion type provided in accordance with the present invention.
Figure 7:
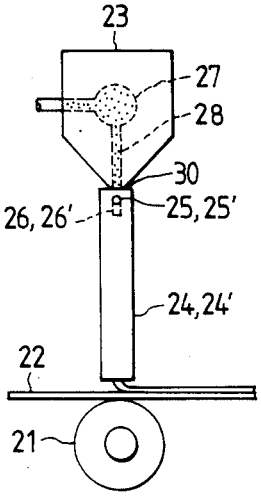
FIG. 7 is a side-elevational view of the apparatus of FIG. 6.

As shown in FIGS. 6 and 7, similar effects can be attained by replacing the slide hopper-type liquid pouring device in FIGS. 4 and 5 with the extrusion-type liquid pouring device 23.

Figure 8:
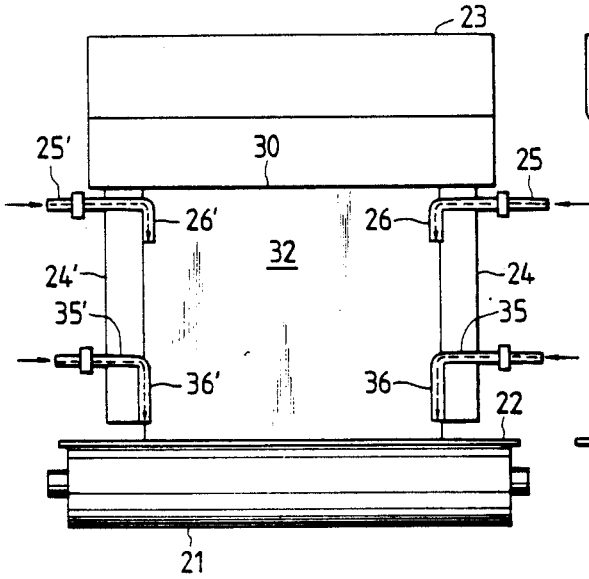
FIG. 8 is a schematic front-elevational view of a coating apparatus of the extrusion type incorporating auxiliary liquid discharge ports at upper and lower portions of a curtain film.
Figure 9:
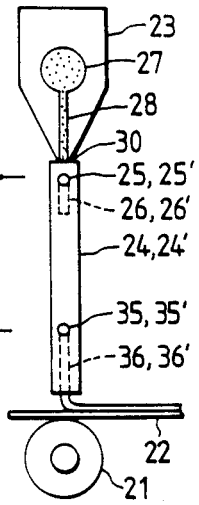
FIG. 9 is a side-elevational view of the apparatus of FIG. 9.

FIG. 8 is a schematic front-elevational view of an extrusion type coating apparatus, as a second embodiment of the invention, and FIG. 9 is a side-elevational view thereof.

In FIGS. 8 and 9, a coating liquid is fed into an extrusion type liquid pouring device 23 by a liquid feed pump (not shown), is passed through a manifold 27 and slots 28, and then reaches a lip portion 30 of the liquid pouring device. Then the coating liquid flows from the lip portion 30 to create a curtain film 32 while being supported by edge guides 24 and 24', and is caused to impinge on a web 22 supported by a backup roller 21 to coat the web.

An auxiliary liquid is fed by a liquid feed pump (not shown) into liquid pouring pipes 25 and 25' mounted respectively on the edge guides 24 and 24' in the vicinity of the lip portion 30 of the liquid pouring device 23 and also into liquid pouring pipes 35 and 35' mounted respectively on these edge guides in the vicinity of a point where the curtain film 32 impinges on the web 22. Then, the auxiliary liquid is caused to flow in a jet from discharge ports 26 and 26' and discharge ports 36 and 36' along the curtain film 32 defined by the downwardly-flowing film of the coating liquid, and is caused to impinge on the web 22 supported by the backup roller 21, together with the curtain film 32 to effect coating.

The discharge ports 6 and 6' (26 and 26') for discharging the jets of the liquid in the direction of flow of the coating liquid are mounted respectively on the edge guides 4 and 4'. (24 and 24'), supporting the opposite side edges of the film-like coating liquid, in the vicinity of the lip portion 10 (30) of the liquid pouring device 10 (23). By doing so, the flow velocity of the coating liquid in the vicinity of the edge guides is increased, so that there is no difference in flow velocity between these portions and the central portion of the curtain film. Therefore, the difference is surface tension between those portions of the curtain film near the edge guides and the central portion of the curtain film is eliminated. As a result, a thinned film which conventionally has been created in the vicinity of each edge guide is overcome, thus enabling formation of a uniform film even when the curtain film is quite tall and when the coating liquid is supplied in a small amount.

With respect to the position of mounting of the discharge ports 6 and 6' (26 and 26'), these ports preferably are disposed within 20 mm from the distal end of the lip portion 10 (30) of the liquid pouring device, and more preferably within 10 mm. The flow rate of the jets of the auxiliary liquid is preferably in the range of 0.2 to 30 cc/min. depending on the height of the curtain film, and more preferably between 0.5 and 20 cc/min.

In the case where the curtain is quite tall, the means for supplying the jets of the liquid preferably are provided not only in the vicinity of the lip portion 10 (30) of the liquid pouring device as described above, but also in the vicinity of the lower portion of the curtain film, as disclosed in the aforesaid Japanese Patent Publication No. 58-37866. More specifically, as shown in FIGS. 8 and 9, the discharge ports 26 and 26' are provided at the upper portion of the curtain film 32, and also the discharge ports 36 and 36' are provided at the lower portion of the curtain film 32. This can overcome the formation of a thinned film in the vicinity of each edge guide.

Although an example of the slide hopper-type liquid pouring device is shown in FIGS. 4 and 5 as an embodiment of the invention while an example of the extrusion-type liquid pouring device is shown in FIGS. 8 and 9, the liquid pouring device used in these structures may be either of the two types.

The coating liquid used in the present invention can comprise various liquid compositions depending on desired use. Examples include a coating liquid for a photosensitive emulsifying agent layer, an undercoat layer, a protective layer, a back layer, etc., used in a photographic photosensitive material; a coating liquid for a magnetic layer, an undercoat layer, a lubricating layer, a protective layer, a back layer, etc., used in a magnetic recording material; a coating liquid for a layer comprising microcapsules as a main component, a layer comprising a developer as a main component, etc., used in an information recording paper; and a coating liquid for a photosensitive layer, a resin layer, a mat layer, etc., used in a presensitized printing plate.

Generally, water is employed as the auxiliary liquid used in the present invention. Particularly, preferred examples of liquids of the type which provide both sufficient support of the curtain film and a reduced drying load for the coated film include an aqueous solution of alcohol such as methanol and ethanol, or a solution of a low-boiling solvent having a boiling point of about 30° to about 150° C., such as lower alkyl acetate such as ethyl acetate and butyl acetate, ethyl propionate, secondary butyl alcohol, methyl isobutyl ketone, $\beta$-ethoxy ethyl acetate, methyl Cellosolve acetate or the like.

The auxiliary liquid should not affect the physical properties of the coating liquid to be used, so as not to affect the quality of the coated film. Therefore, the auxiliary liquid is suitably selected depending on the kind of the coating liquid to be used.

Examples of the web used in the present invention include paper, plastic film, metal resin-coated paper, and synthetic paper. The plastic film may be made of polyolefin such as polyethylene and polypropylene, a vinyl polymer such as polyvinyl acetate, polyvinyl chloride and polystyrene, a polyamide such as 6,6-nylon and 6-nylon, a polyester such as polyethylene terephthalate and polyethylene-2,6-naphthalate. polycarbonate, cellulose acetate such as cellulose triacetate and cellulose diacetate, or the like. A typical example of resin used for the resin-coated paper is polyolefin such as polyethylene but, the resin need not be limited to these. An example of a metal web is an aluminum web.

EXAMPLE 1

To make clearer the advantageous effects of the present invention, the following Examples are given:

First, using a construction in which the discharge ports for the auxiliary liquid are disposed in the vicinity of the lip portion of the liquid pouring device which corresponds to the slide hopper-type coating apparatus shown in FIGS. 4 and 5, an experiment was carried out using a coating liquid shown in Table 1.

A minimum flow rate for film formation was determined for a case in which the coating liquid was coated on a web of a triacetate cellulose film at a curtain film height of 100 mm at a coating rate of 100 m per minute.

For comparison purposes, an experiment first was carried out using a conventional coating apparatus which did not use any auxiliary liquid. It was found that when the film formation flow rate was below 1.5 cc/cm.sec, the liquid film became separated from the edge guides, so that the curtain film was not formed Also, there was a thinned film condition in the vicinity of the edge guides.

TABLE 1

| | | |
|---|---|---|
| Coating liquid: | gelatin | 50 g |
| | dodecyl benzene sodium sulfonate | 1 g |
| | polyvinyl benzene potassium sulfonate | 1.25 g |
| | water | 950 g |
| Viscosity: | 50 cp (40° C.) | |
| Surface tension: | 33 dyne/cm (40° C.) | |

On the other hand in accordance with the present invention, an experiment was carried out using water as the auxiliary liquid which was caused to flow in jets at a rate of 5 cc/min. As a result it was found that the minimum flow rate for the film formation could be lowered to 1.2 cc/cm.sec.

Further when the water as the auxiliary liquid was caused to flow in jets at a rate of 10 cc/min., the minimum film formation flow rate was lowered to 0.7 cc/cm.sec. A thinned film hardly existed in the vicinity of the edge guides when the flow rate of the jet of the water was 10 cc/min.

EXAMPLE 2

Next, using a construction in which the discharge ports for the auxiliary liquid were disposed at the upper and lower portions of the curtain film, which corresponds to the extrusion type coating apparatus shown in FIGS. 8 and 9, an experiment was carried out using a coating liquid shown in Table 1.

The coating liquid was coated on a web of a triacetate cellulose film at a curtain film height of 100 mm at a coating rate of 100 m/min., with water as the auxiliary liquid flowing in jets from the upper discharge ports at a rate of 10 cc/min., and with water as the auxiliary liquid flowing in jets from the lower discharge ports at a rate of 15 cc/min. The result was that the minimum film formation flow rate was lowered to 0.7 cc/cm.sec, and it was confirmed by measuring a film thickness that no thinned film was formed on opposite sides portions of the coated sample.

As described above, according to the present invention, in a coating apparatus in which at least one coating liquid is caused to impinge on the substrate to be coated so as to coat the same, the formation of thinned films in the vicinity of the edge guides supporting the opposite side edges of the coating liquid film is prevented by providing appropriate discharge jets for discharging an auxiliary liquid in that area. As a result, a uniform coating can be effected at a low flow rate. In particular, the invention contributes to uniformity of quality and improved productivity in the coating of a photographic photosensitive material and of other materials which require a high precision coating.

We claim:

1. A coating apparatus comprising:

a liquid pouring device for providing a curtain of a coating liquid to be coated on a surface of a substrate, said liquid pouring device having a lip portion from which said curtain of liquid emerges, and edge guide portions extending from side edge portions of said lip portion to respective positions adjacent said substrate for supporting opposite edges of said curtain of coating liquid; and discharge means for discharging an auxiliary liquid in a jet in a direction of downward flow of the coating liquid, said discharge means being mounted on said edge guide portions, in the vicinity of said lip portion and discharging said auxiliary liquid along said opposite edges of said curtain of liquid along said edge guide portions.

2. A coating apparatus according to claim 1, in which said discharge means are mounted within 20 mm of the lip portion of the liquid pouring device.

3. A coating apparatus as claimed in claim 1, further comprising second discharging means for discharging an auxiliary liquid along edge portion of said curtain of coating liquid in a direction of downward flow of the coating liquid, said second discharging means discharging said auxiliary liquid along said opposite edges of said curtain of liquid from a position at a lower end of said edge guide portions.

4. A coating apparatus as claimed in claim 1, wherein said liquid pouring device comprises a slide-hopper.

5. A coating apparatus as claimed in claim 1, wherein said liquid pouring device comprises an extrusion hopper.

* * * * *